US005775129A

United States Patent [19]

Satchell, Jr. et al.

[11] Patent Number: 5,775,129

[45] Date of Patent: Jul. 7, 1998

[54] HEAT EXCHANGER

[75] Inventors: Donald Prentice Satchell, Jr., Summit; Venkat Natarajan, Scotch Plains, both of N.J.; Richard Henry Clarke, Abingdon, United Kingdom

[73] Assignee: The BOC Group, Inc., New Providence, N.J.

[21] Appl. No.: 816,233

[22] Filed: Mar. 13, 1997

[51] Int. Cl.[6] ..... F25J 3/04; F28B 1/00

[52] U.S. Cl. ..... 62/643; 62/903; 165/110

[58] Field of Search ..... 62/643, 903; 165/110, 165/115; 202/154

[56] References Cited

U.S. PATENT DOCUMENTS

| | | | |
|---|---|---|---|
| 3,880,231 | 4/1975 | Gauthier | 62/903 X |
| 3,992,168 | 11/1976 | Toyama et al. | 62/903 X |
| 5,014,773 | 5/1991 | Beduz et al. | 165/115 |
| 5,071,458 | 12/1991 | Grenier et al. | 62/903 X |
| 5,122,174 | 6/1992 | Sunder et al. | 62/903 X |
| 5,205,351 | 4/1993 | Muller et al. | 165/110 |
| 5,222,549 | 6/1993 | Ishii et al. | 165/110 |
| 5,233,839 | 8/1993 | Greter et al. | 62/903 X |
| 5,537,840 | 7/1996 | Srinivasan et al. | 62/643 |
| 5,667,643 | 9/1997 | Satchell, Jr. et al. | 202/154 |
| 5,682,945 | 11/1997 | Lehman | 62/903 X |

*Primary Examiner*—Christopher Kilner
*Attorney, Agent, or Firm*—David M. Rosenblum; Salvatore P. Pace

[57] ABSTRACT

A heat exchanger for use within a sump to condense an vapor and to vaporize the liquid. The heat exchanger includes a core having alternating passages to vaporize the liquid and to condense the vapor. Liquid is distributed into passages through a liquid distributor and the passages involved in vaporizing the liquid are provided with a down flow, stage and one or more thermosiphon stages situated below the down flow stage. In such manner, part of the liquid is vaporized within the down flow stage and the remainder is vaporized within the thermosiphon stage or stages.

10 Claims, 3 Drawing Sheets

HEAT EXCHANGER

BACKGROUND OF THE INVENTION

The present invention relates to a heat exchanger for use within a sump to condense a vapor and to vaporize the liquid. More particularly, the present invention relates to such a heat exchanger having a down flow stage which functions as a falling film device to vaporize part of the liquid and one or more thermosiphon stages that function in a thermosiphon reboiling mode to vaporize the remaining part of the liquid.

A common application of a heat exchanger is that of condenser-reboilers used in distillation columns. In such application, a heat exchanger is located within a sump of a distillation column or a tank which functions as a sump, to condense a vapor against boiling a liquid. For instance, in double column air separation units, a heat exchanger vaporizes liquid oxygen collecting within a sump of a lower pressure column against condensing nitrogen formed as tower overhead in a higher pressure column. The boiling liquid oxygen produces boilup for the lower pressure column and the liquid nitrogen is used as reflux to both the higher and lower pressure columns.

In one type of heat exchanger, heat exchange between the liquid and the vapor is effectuated by a down flow mode of operation in which liquid is distributed into liquid passages to form a falling film of the liquid. In adjacent passages, the vapor circulates countercurrently to vaporize the liquid against condensing the vapor. Such down flow mode of operation has the distinct advantage of providing a low pressure drop and therefore a decreased average temperature difference for heat transfer. However, in case of air separation applications, the down flowing liquid increases in hydrocarbon concentration as the liquid oxygen is vaporized. Thus, generally, not more than 50% of the liquid oxygen feed is vaporized. If the air separation plant produces no liquid product, then liquid oxygen must be recycled at a flow rate that is roughly equal to the low pressure column reflux rate. This recycle pump substantially increases the operational costs of the air separation plant. Even with an air separation plant that has a substantial oxygen product, the pump adds irreversible energy to the lower pressure column must be overcome with added refrigeration.

Another type of heat exchanger employs thermosiphon reboiling. In such heat exchanger pressure drops are greater than down flow devices. In case of air separation, in order to maintain a sufficient temperature difference, a sufficient pressure difference must be maintained between high and low pressure columns. This translates into increased energy costs.

As will be discussed, the present invention provides a heat exchanger having the advantageous low pressure drop characteristics of a down flow reboiler. At the same time, since only part of the vaporization of the liquid is conducted in a down flow mode, the heat exchanger does not require an external pump to guarantee the presence of liquid within the heat exchanger.

SUMMARY OF THE INVENTION

The present invention provides a heat exchanger for use within a surrounding sump to condense a vapor and to vaporize the liquid. In accordance with the present invention, a core is provided with first and second heat exchange passages alternating with one another so that the vapor flowing in the first heat exchange passages undergoes heat transfer with liquid flowing in the second heat exchange passages. A first inlet and outlet means is provided for introducing the vapor into the first passages and for discharging condensed vapor from the first passages, respectively. A liquid distributor is provided for introducing the liquid into the second passages. The second passages have a down flow stage and at least one thermosiphon stage. The down flow stage is positioned to directly receive the liquid from the liquid distributor thereby to allow formation of a falling film of the liquid and vaporization of part of the liquid received there within. The at least one thermosiphon stage is positioned to receive a remaining part of the liquid from the down flow stage and is configured to operate submerged within the liquid, thereby to produce a convective flow of the liquid and additional vaporization of the liquid. The down flow and at least one thermosiphon stages are separated from one another so that the remaining part of the liquid is prevented from falling directly into the at least one thermosiphon stage. Ports are defined in the core above and below the separation between the down flow and the at least one thermosiphon stage to allow at least part of the vaporized liquid produced within the down flow stage and the remainder of the liquid not vaporized within the down flow stage to be discharged from the core and to also allow the convective flow of the liquid and the additional vapor produced within the at least one thermosiphon stage to be discharged from the core.

It is understood that the terms "vapor" and "liquid" as used herein and in the claims are meant to denote a physical state rather than a particular vapor or liquid composition. For instance, as would be known to one skilled in the art, the "liquid" being distributed by the liquid distributor, the "liquid" not vaporized within the down flow stage, the convective "liquid" within the one or more thermosiphon stages would not all necessarily have the same composition due to mass transfer occurring between liquid and vapor.

The heat exchanger of the present invention stages the vaporization between a down flow stage and one or more thermosiphon stages so that only part of the liquid is vaporized in the down flow stage and the remaining part of the liquid is vaporized within one ore more thermosiphon stages. Thus, there is no need to recirculate liquid via a pump. Moreover, since the vapor to be condensed does not have to in its entirety pass through liquid, the pressure drop characteristics of the heat exchange of the present invention approach that of a prior art down flow reboiler.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

Figure 2:
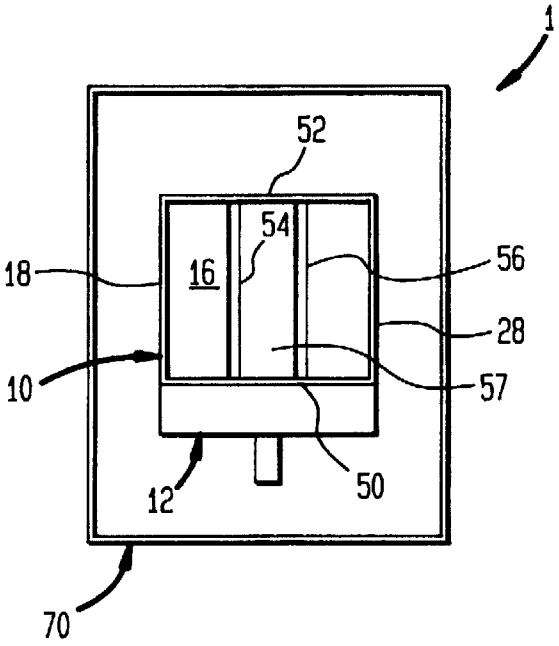
FIG. 2 is a top plan view of FIG. 2.
Figure 1:
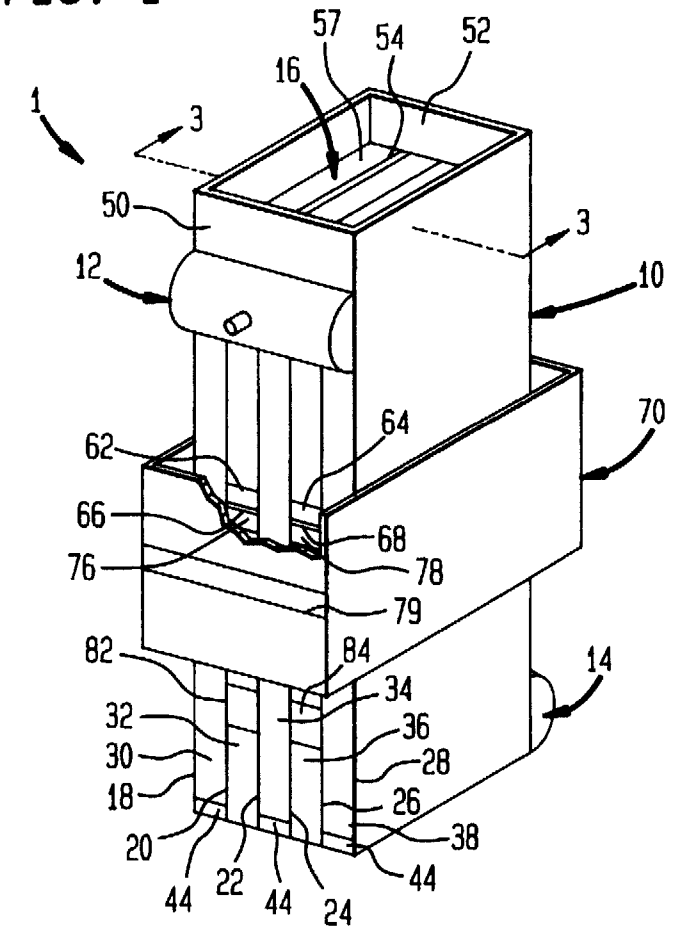
FIG. 1 is a perspective view of a heat exchanger in accordance with the present invention with part of an auxiliary sump broken away.

For sake of clarity, a column shell forming a sump within which heat exchanger sits is not illustrated in FIGS. 1 and 2.

DETAILED DESCRIPTION

With reference to FIGS. 1 and 2, a heat exchanger 1 in accordance with the present invention as illustrated. Heat exchanger 1, is designed to be used in connection with a sump surrounding heat exchanger 1 to collect liquid. Although the application of the present invention is not limited to any particular type of distillation, such surrounding sump could be a sump of a low pressure column of a double column air separation unit used in separating nitrogen and oxygen.

Heat exchanger 1 consists of a core 10, an inlet manifold 12 for introducing vapor into core 10 and an outlet manifold 14 for discharging the condensed vapor from core 10. A liquid distributor 16 is provided for introducing liquid into core 10. Core 10 is preferably formed by a plurality of plates 18, 20, 22, 24, 26 and 28. Extruded construction is also possible. Plates 18 through 28 are brazed to vertical spacer bars 30–38. Similar spacer bars are brazed to plates 18, 20, 22, 24, 26, and 28 on the opposite side of core 10, not visible in FIGS. 1 and 2 of the drawings. It is to be noted that vertical spacer bars 30 and 36 are not continuous so as to form ports (62,64, 76,68, and 82,84 to be discussed in more detail hereinafter.)

Figure 3:
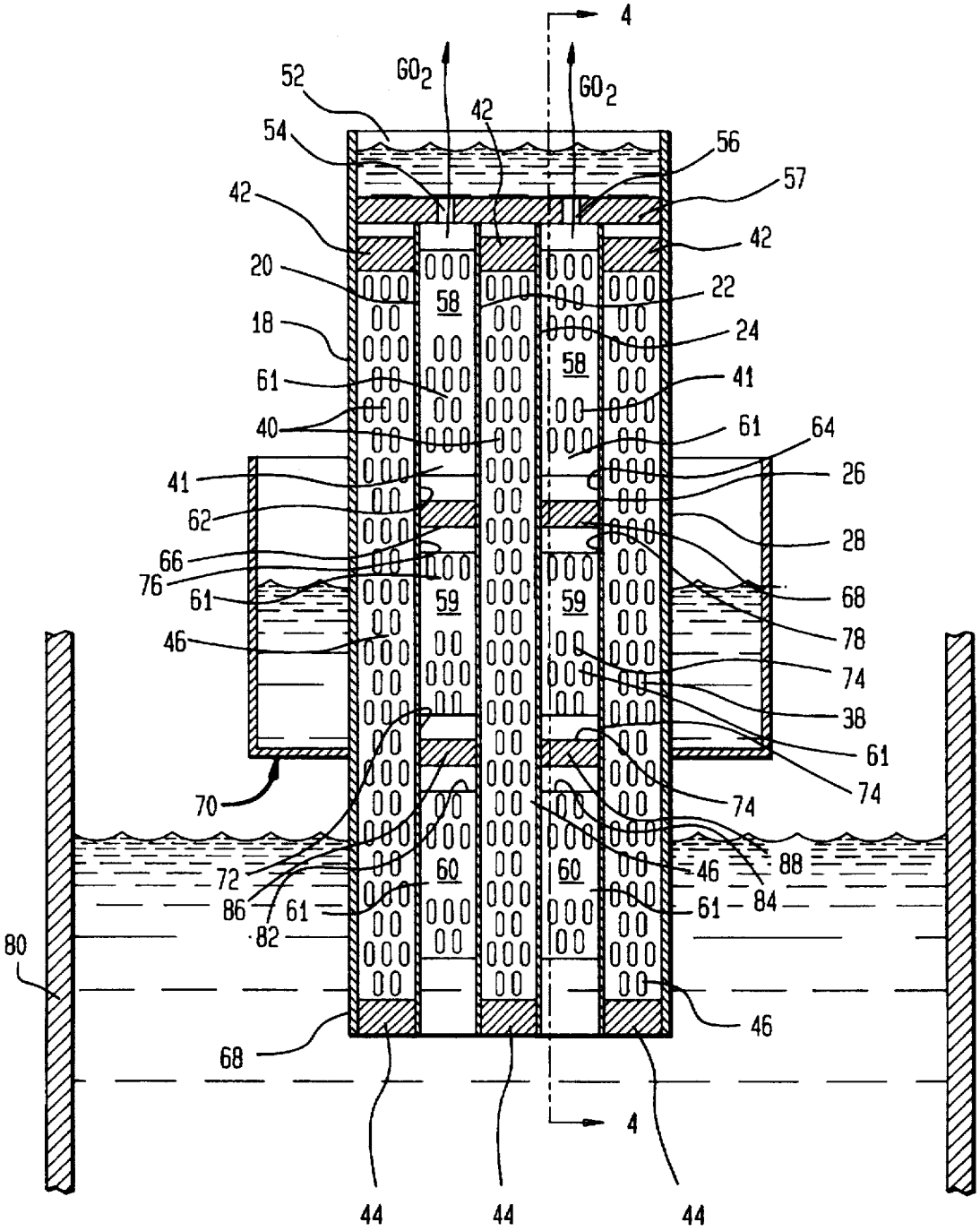
FIG. 3 is an enlarged, cross sectional view along line 3—3 of FIG. 1.
Figure 4:
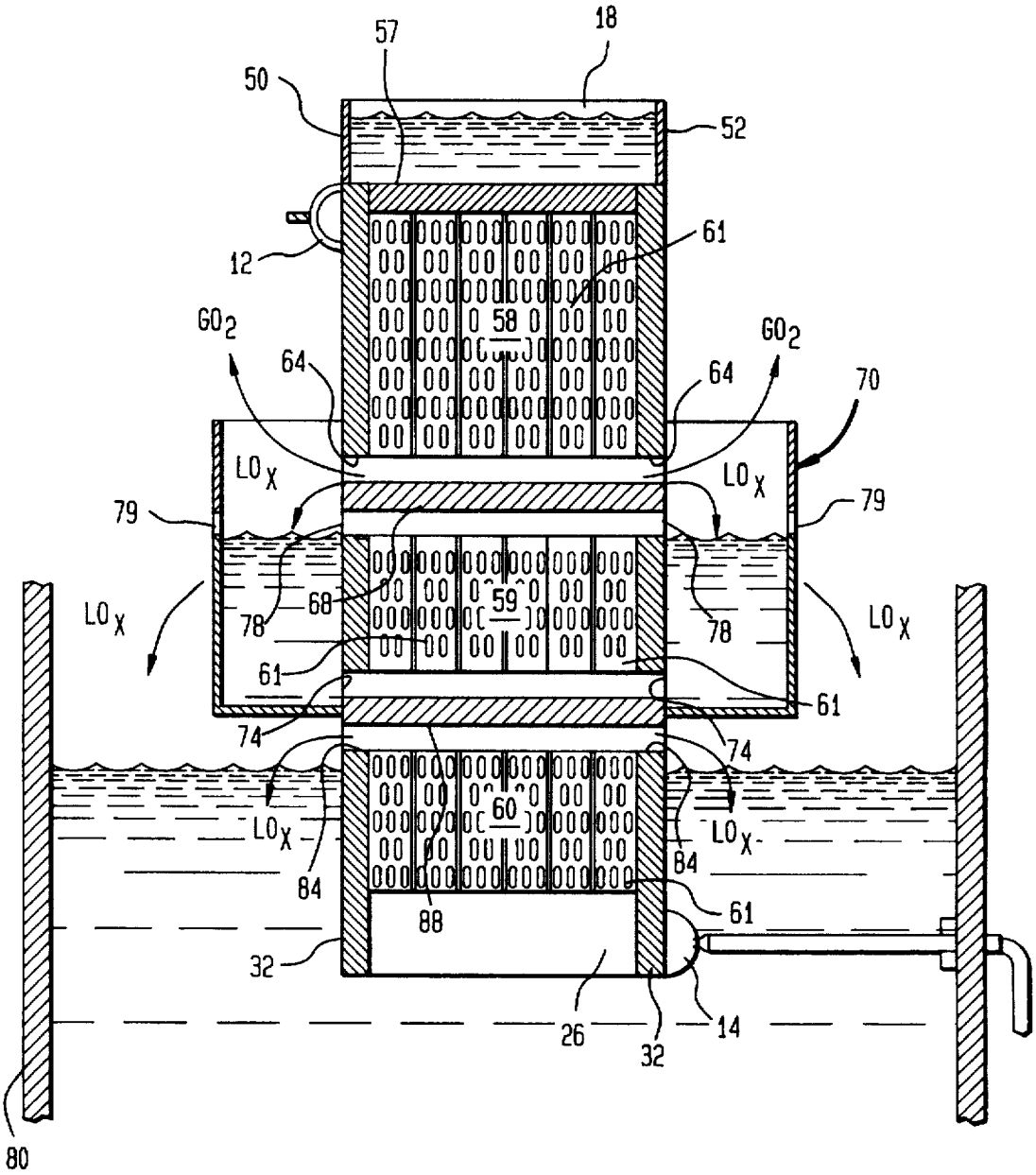
FIG. 4 is an enlarged, cross sectional view along line 4—4 of FIG. 3.

With additional reference to FIGS. 3 and 4, plates 18–28 form first and second heat exchange passages 40 and 41 that alternate with one another to allow heat exchange between vapor flowing within first passages 40 and liquid flowing second passages 41. Such heat exchange causes eventual condensation of vapor and vaporization of liquid. Although not illustrated, vertical spacer bars 30, 34 and 36 terminate in a conventional manner, near the point of attachment of inlet manifold 12 to permit vapor to enter first passages 40. Additionally, first passages 18 are sealed at opposite ends with horizontal spacer bars 42 and 44. In order to enhance the effective area for heat transfer corrugated fin-type material 46 is placed within each of first passages 40. As stated previously, vertical spacer bars, such as designated by reference numbers 30–38, are provided on the side of core 10 hidden from view in the drawings. Such hidden from view vertical spacer bars terminate in a conventional manner near the point of attachment of outlet manifold 14 to allow condensed vapor to flow out of first passages 40.

Liquid is introduced in second passages 41 by liquid distributor 16. A reservoir of liquid distributor 16 (used in collecting liquid) is formed by top sections of outermost vertical plates 18 and 28 and transverse plates 50 and 52. Such liquid could be down coming liquid oxygen from the lower most tray of a low pressure column of an air separation plant. Liquid collects within the reservoir thus formed and then flows through apertures 54 and 56 (defined in a distributor plate 57) into second passages 41.

Each of second passages 41 are provided with a down flow stage 58 and first and second thermosiphon stages 59 and 60. In down flow stage 58, liquid distributed into second passages 41 forms a film on plates 20, 22 and 24, 26 and on corrugated fin material 61 located therewithin. Vaporized liquid then flows out of apertures 54 and 56 of distributor plate 57 and also out of ports 62 and 64 provided within core 10 above a pair of transverse dividing bars 66 and 68 separating down flow stage 58 and first thermosiphon stage 59. Liquid that has not been vaporized drops on to transverse dividing bars 66 and 68 and flows into an auxiliary sump 70 connected on to core 10.

Liquid enters first thermosiphon stage 59 through ports 72 and 74. Convention causes liquid to flow in an upward direction, through corrugated fin material 61. The ascending liquid is discharged from ports 76 and 78 defined in core 10 below dividing bars 66 and 68 and falls back into auxiliary sump 70. Any liquid which is vaporized is also expelled from ports 76 and 78. Liquid from both down flow stage 58 and from thermosiphon stage 59 collects within auxiliary sump 70 after which it overflows through openings 79 (which can be in the form of slots defined within sidewalls of auxiliary sump 70) and then falls into a sump within which core 10 is contained. It is to be noted, that as illustrated, the bottom of ports 76 and 78 are preferably flush with the bottom of openings 79.

Again, the sump connected with the use of heat exchanger 1 could be the sump of a distillation column which is illustrated as distillation column sidewall 80. By the same token, in place of a distillation column, the sump could be formed by a separate a tank. Liquid collected with the sump rises through core 10 (open at the bottom of second passages 41) and flows through second thermosiphon stage 60 within which corrugated fin-type material 61 is also provided. Liquid by convection overflows second thermosiphon stage 60 and (along with any vaporized liquid) is discharged from ports 82 and 84 defined within core 10. Transverse dividing bars 86 and 88 separate first and second thermosiphon stages 59 and 60 from one another so that they can separately function.

Preferably, no more than about 50% of the liquid is vaporized within down flow section 58. The remainder is vaporized within first and second thermosiphon sections 59 and 60. Preferably, apertures 54 and 56 (or the open area of any liquid distribution system used) are sized to allow both liquid and vaporized liquid to escape from liquid distributor 16. In the event that the turn down transient is encountered and core 10 is completely submerged, the foregoing preferable sizing of apertures 54 and 56 allows the vaporization process to be restarted with the entire core 10 temporarily functioning as a thermosiphon reboiler.

Although two thermosiphon first and second thermosiphon stages 59 and 60 are illustrated, the present invention can be said to contemplate construction with one or more thermosiphon stages. In case of more than two thermosiphon stages, additional auxiliary sumps (such as auxiliary sump 70) would be required. If only one thermosiphon stage were included, auxiliary sump 70 would not be required and second passages 41 of such thermosiphon stage would be open at the bottom to receive liquid. It is to be noted that in any embodiment the one or more thermosiphon stages are preferably anywhere from about 65% and about 70% of the height of core 10.

Although the present invention has been discussed with reference to a preferred embodiment, as will occur to those skilled in the art, numerous changes, additions and omissions may be made without departing from the spirit and scope of the present invention.

We claim:

1. A heat exchanger for use within a surrounding sump to condense a vapor and vaporize a liquid, said heat exchanger comprising:

a core having first and second heat exchange passages alternating with one another so that said vapor flowing in said first heat exchange passages undergoes heat transfer with said liquid flowing in said second heat exchange passages;

first inlet and outlet means for introducing said vapor into said first passages and for discharging condensed vapor from first passages, respectively;

a liquid distributor for introducing said liquid into said second passages;

said second passages having a down flow stage and at least one thermosiphon stage;

said down flow stage positioned to directly receive said liquid from said liquid distributor, thereby to allow formation of a falling film of said liquid and vaporization of part of the liquid received there within;

said at least one thermosiphon stage positioned to receive a remaining part of said liquid from said down flow stage and configured to operate submerged within said liquid, thereby to produce a convective flow of said liquid and additional vaporization of said liquid;

said down flow and at least one thermosiphon stages separated from one another so that said remaining part of said liquid is prevented from flowing directly into said at least one thermosiphon stage; and ports defined in said core above and below the separation between said downflow stage and said at least one thermosiphon stage to allow at least part of the vaporized liquid produced within said down flow stage and said remainder of said liquid not vaporized within the down flow stage to be discharged from said core and to also allow said convective flow of said liquid to overflow said at least one thermosiphon stage and said additional vapor to be discharged from said core.

2. The heat exchanger of claim 1, wherein said core is formed by a plurality of plates defining said first and second heat exchange passages between said plates.

3. The heat exchanger of claim 1 in which said distributor has an open area configured such that upon submergence of said core within said liquid, both vaporized liquid and liquid can escape from said core to allow said down flow stage to function as a thermosiphon reboiler.

4. The heat exchanger of claim 1, wherein:

first and second thermosiphon stages form two of said at least one thermosiphon stages with said first thermosiphon stage located adjacent said down flow stage and said second thermosiphon stage located below said first thermosiphon stage;

said first and second thermosiphon stages are separated from one another;

an auxiliary sump surrounds said first thermosiphon stage and is configured such that said first thermosiphon stage operates submerged within said liquid, said auxiliary sump having openings to allow overflow liquid, collected within said auxiliary sump to overflow and fall into said surrounding sump; and said second passages being open at a bottom region of said core to allow liquid to ascend by convection within said second thermosiphon stage and said core having additional ports to allow ascending liquid to overflow said second thermosiphon stage along with further vapor produced within said second thermosiphon stage.

5. The heat exchanger of claim 3 in which said distributor has an open area configured such that upon submergence of said core within said liquid, both vaporized liquid and said liquid can escape from said core to allow said down flow stage to function as a thermosiphon reboiler.

6. The heat exchanger of claim of claim 1, wherein said distributor compr ises a reservoir to collect said liquid and having a distributor plate form a base to said reservoir and said distributor has transverse slots overlying said second passages so that said liquid collected within said reservoir is distributed through said slots to said second passages.

7. The heat exchanger of claim 6 in which said slots have an open area configured such that upon submergence of said core within said liquid, both vaporized liquid and liquid can escape from said core to allow said down flow stage to function as a thermosiphon reboiler.

8. The heat exchanger of claim 7, wherein:

first and second thermosiphon stages form two of said at least one thermosiphon stages with said first thermosiphon stage located adjacent said down flow stage and said second thermosiphon stage located below said first thermosiphon stage;

said first and second thermosiphon stages are separated from one another;

an auxiliary sump surrounds said first thermosiphon stage and is configured such that said first thermosiphon stage operates submerged within said liquid, said auxiliary sump having openings to allow overflow liquid, collected within said auxiliary sump to overflow and fall into said surrounding sump; and said second passages being open at a bottom region of said core to allow liquid to ascend by convection within said second thermosiphon stage and said core having additional ports to allow ascending liquid to overflow said second thermosiphon stage along with further vapor produced within said second thermosiphon stage.

9. The heat exchanger of claim 8, wherein said core is formed by a plurality of plates defining said first and second he at exchange passasges.

10. The heat exchanger of claim 9, wherein said first and second passages are filled with corrugated fin-type material.

* * * * *